United States Patent [19]

Lane, Sr.

[11] Patent Number: 4,875,620

[45] Date of Patent: Oct. 24, 1989

[54] FLUTED PRODUCT CUP

[75] Inventor: William A. Lane, Sr., Redlands, Calif.

[73] Assignee: W. A. Lane, Inc., San Bernardino, Calif.

[21] Appl. No.: 266,409

[22] Filed: Nov. 2, 1988

[51] Int. Cl.[4] ..... B65D 1/20

[52] U.S. Cl. ..... 229/1.5 B; 220/23.4; 220/23.8; 426/108; 426/115; 426/119; 206/820

[58] Field of Search ..... 220/23.4, 23.8; 206/602, 633, 513, 519, 820; 229/125.35, 1.5 B; 222/572, 573; 426/115, 108, 119

[56] References Cited

U.S. PATENT DOCUMENTS

| | | | |
|---|---|---|---|
| 2,988,208 | 6/1961 | Loew | 229/125.35 X |
| 3,054,679 | 9/1962 | Bradford | 206/820 X |
| 3,321,123 | 5/1967 | Collie | 229/125.35 X |
| 3,443,741 | 5/1969 | Stockdale | 229/125.35 X |
| 4,054,207 | 10/1977 | Lazure et al. | 220/23.4 X |
| 4,296,863 | 10/1981 | Stokkers | 206/504 |

FOREIGN PATENT DOCUMENTS

| | | | |
|---|---|---|---|
| 1116141 | 10/1961 | Fed. Rep. of Germany | 229/1.5 B |
| 2551485 | 5/1976 | Fed. Rep. of Germany | 206/820 |
| 2928626 | 2/1981 | Fed. Rep. of Germany | 229/1.5 B |
| 2291111 | 6/1976 | France | 206/820 |

OTHER PUBLICATIONS

Photocopy of a "Cream Cup", Publication unknown; however to best of knowledge believed to be in public domain at least one year prior to Nov. 1, 1988. Source—a photograph in possession of applicant.

*Primary Examiner*—Stephen Marcus
*Assistant Examiner*—Jes F. Pascua
*Attorney, Agent, or Firm*—Herb Boswell

[57] ABSTRACT

A packaging cup formed from a resilient material has an integrally body having a product reservoir and a lip. The product reservoir includes a flat bottom wall and a continuous side wall integrally joined together about a smooth curve. The side wall extends upwardly from the bottom wall to join the lip. The joint between the lip and the side wall continuously surrounds and defines an opening through the lip to the interior of the reservoir. The lip extends in a plane outwardly from this opening completely around the periphery of this opening. The bottom wall is essentially circular in shape and the opening is essentially squarish in shape. First, second, third and fourth fluted areas are located in the side wall at the corners of the squarish shaped opening. Each of the fluted areas is shaped essentially as a conical surface generated from a cone which is truncated by a plane about a parabolic intersecton of the plane with the cone. With the exception of the first, second, third and fourth fluted areas, the remainder of the side wall is formed as an essentially smooth, continuous surface.

20 Claims, 2 Drawing Sheets

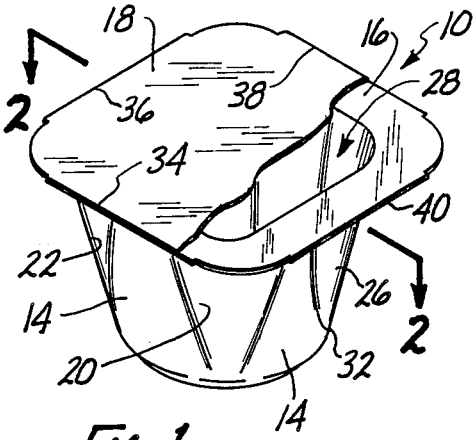
FIG. 1
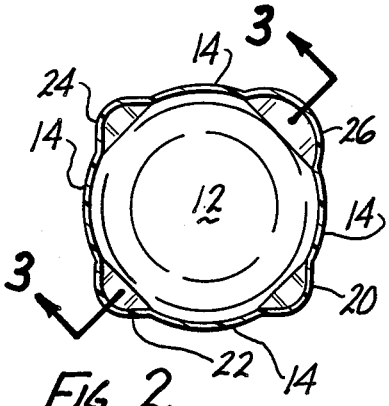
FIG. 2
FIG. 4
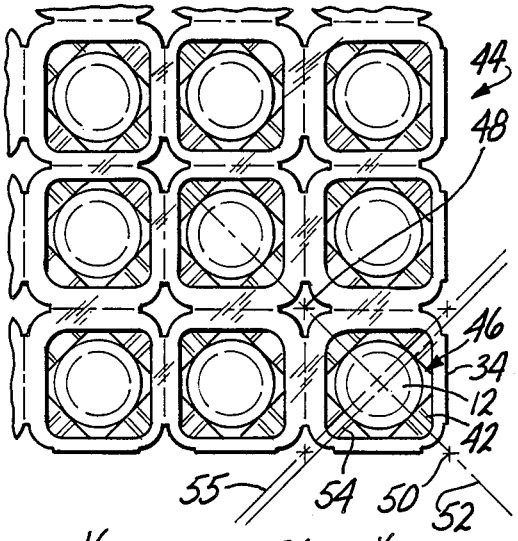
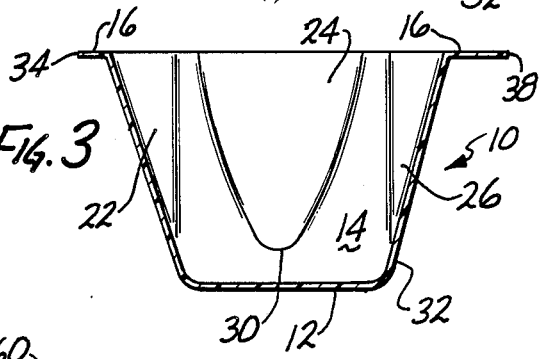
FIG. 3
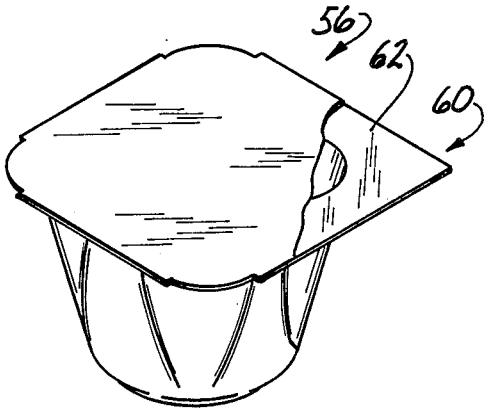
FIG. 5
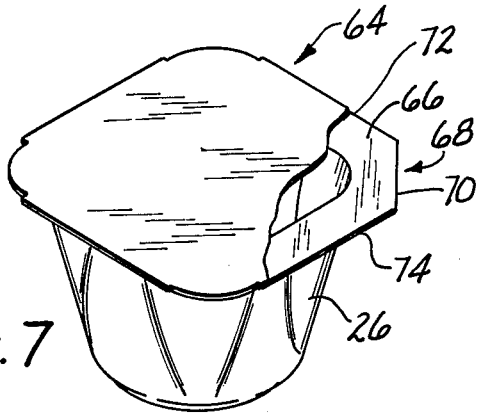
FIG. 7

FLUTED PRODUCT CUP

BACKGROUND OF THE INVENTION

This application is directed to a symmetrically shaped product cup having a flat bottom converging into a continuous side wall which in turn converges into a planar lip. One or more fluted features are formed in either the side wall or the lip for structural integrity and ease of dispensing of product from the packaging cup.

Packaging cups are known which are utilized for holding either liquid, semi solid or solid products. These include packaging cups for condiments and food stuffs such as catsup, mustard, pudding and syrup, packaging cups for beverage additives such as liquid or powdered cream and packaging cups for individual servings of spreads such as honey, jellies, butter and margarine.

These cups are normally formed utilizing a thermo form process, filled with product and sealed with a foil or film cover. The cups can be formed, filled and sealed on a single machine or preferably formed independently from the filling and sealing operation. By forming the cups independent of the fill and seal operations the complexity of the machinery needed is lessened resulting in economy of operation.

As independently formed in a thermo forming process, a matrix of cups is formed from a single sheet of resilient material. The matrix of the cups can then be loaded onto a fill and seal cup packager where the cups are filled and then hermetically sealed with an appropriate peelable foil or film covering. The cups are then separated from one another by cutting and packaged for distribution.

For dispensing individual servings of cream in either liquid or powder form, or for butter or margarine, a very small volume cup is needed since the amount of product dispensed for an individual serving is small. Typically these small cups are designed to hold only about ½ ounce of material. Especially for cream, either in a liquid or in a dry form, it is important for the cup to have a proper "feel" since the consumer utilizes the cup directly as the dispensing utensil for adding the cream product to coffee or tea. For this purpose generally a cup having a rounded shaped has been found to be more consumer acceptable than other shapes.

A round shaped cup, however, is not an optimum design for utilization on a fill and seal cup packager. Further, a cup with a round lip is not an optimal design for material conservation since excess material must be trimmed (e.g. die cut) after filling and sealing to form the round lip of the cup. Trimming either must be done as a separate operation on a separate machine or if it is done directly on a cup packager, since trimming waste must be removed as a part of the cup packager working cycle, this requires a more complex cup packager.

To circumvent trimming, prior cream cups have been formed having a round bottom which tapers upwardly into a square shape. In order to strengthen the cup, these cups are then fluted with a plurality of vertical ridges which extend completely around the cup from the cup lip to the cup bottom and the bottom of the cups is circumferentially indented. The multiple vertically extending flutes and the indented bottom inherently increases the complexity of the cup forming die and the carrier plates of the cup packager. This has increased the expense of producing these prior cups and thus ultimately renders the product package therein less economical to the consumer.

BRIEF DESCRIPTION OF THE INVENTION

It is an object of this invention to provide new and improved packaging cups. It is a further object of this invention to provide packaging cups which can be utilized to hold small volumes of either solid or liquid contents while still presenting the consumer with a cup shape which is pleasing to the consumer in manipulating the cup to dispense its product. Additionally, it is an object of this invention to provide a cup which because of the engineering principles incorporated therein is inherently strong and will not collapse when manipulated by the consumer. Further, it is an object of this invention to provide a cup which includes inherent structural features for facilitating dispensing of the contents of the cup.

These and other objects as will become evident from the remainder of this specification are achieved in a packaging cup comprising a resilient integrally formed body having a product reservoir and a lip. The product reservoir includes a flat bottom wall and a continuous side wall integrally joined together about a smooth curve. The side wall extends upwardly from the bottom wall to join the lip. The joint between the lip and the side wall continuously surrounds and defines an opening through the lip to the interior of the reservoir. The lip extends in a plane outwardly from this opening completely around the periphery of this opening. The bottom wall is essentially circular in shape and the opening is essentially squarish in shape. First, second, third and fourth fluted areas, as viewed from the interior of the reservoir, are located in the side wall at the corners of the squarish shaped opening. Each of the fluted areas is shaped essentially as a conical surface generated from a cone which is truncated by a plane about a parabolic intersection of the plane with the cone. The bases of these conical surfaces are oriented towards the joint between the lip and the side wall and the apices of these conical surfaces are oriented toward the bottom wall. With the exception of the first, second, third and fourth fluted areas, the remainder of the side wall is formed as an essentially smooth, continuous surface.

In one embodiment of the invention three of the fluted areas are identical and the remaining one of the fluted areas is disimilar with respect to the radius of curvature of the other three fluted areas.

In a further embodiment of the invention the outside periphery of the lip is divided into four outside edges of essentially equal length joined together at corners to form an essentially squarish shape with the center of the essentially circular bottom wall being offset from the point of intersection of diagonal lines which bisect these corners.

In an additional embodiment of the invention a first two of the outside peripheral edges of the lip intersect at a first corner with the remaining two outside peripheral edges of the lip intersecting at a second corner. The areas of the lip between the first two intersecting outside peripheral edges and the periphery of the opening is greater in width than areas of the lip between the remaining two intersecting outside peripheral edges and the periphery of the opening.

In the packaging cups of the invention the apices of the conical surfaces of the identical fluted areas and the disimilar fluted area are positioned essentially at the intersection of the side wall with the bottom wall. Additionally, the conical surface of the disimilar fluted area has a greater radius of curvature than the radius of curvature of the three identical fluted areas.

In one embodiment of the invention each of the corners wherein the outside edges of the lip meet are essentially formed as rounded corners. In a further embodiment of the invention three of these corners are formed as rounded corners with the remaining corner being essentially a 90° corner. In even a further embodiment of the invention three of these corners are rounded and the remaining corner is truncated having an edge which is angled essentially 135° from each of the two intersecting outside edges which form this corner.

BRIEF DESCRIPTION OF THE DRAWINGS

This invention will be better understood when taken in conjunction with the drawings wherein:

FIG. 1 is isometric view of a first embodiment of an fluted packaging cup of the invention;

FIG. 2 is a sectional view about the line 2—2 of FIG. 1;

FIG. 3 is a sectional view about the line 3—3 of FIG. 2;

FIG. 4 is a top plan view (or a bottom plan view since they are essentially the same) of a matrix of joined cups of the type of illustrated in FIG. 1 prior to filling, sealing and separating the cups;

FIG. 5 is an isometric view of a further embodiment of the invention which differs from the embodiment of FIG. 1 with respect to the shape of the lip of the cup at one corner thereof;

Figure 6:
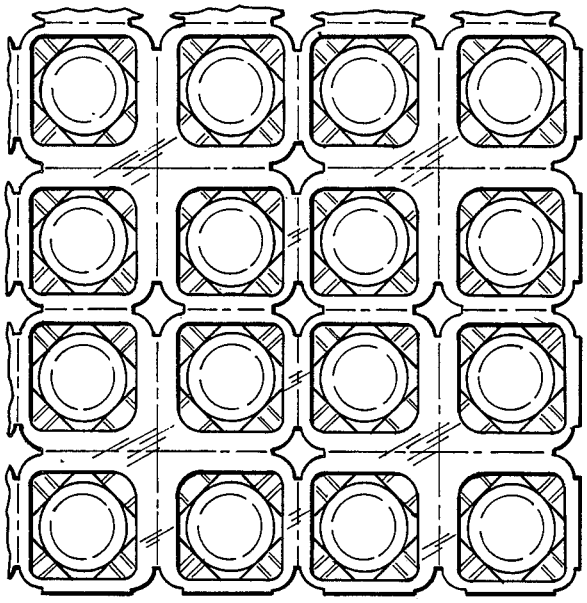
Figure 8:
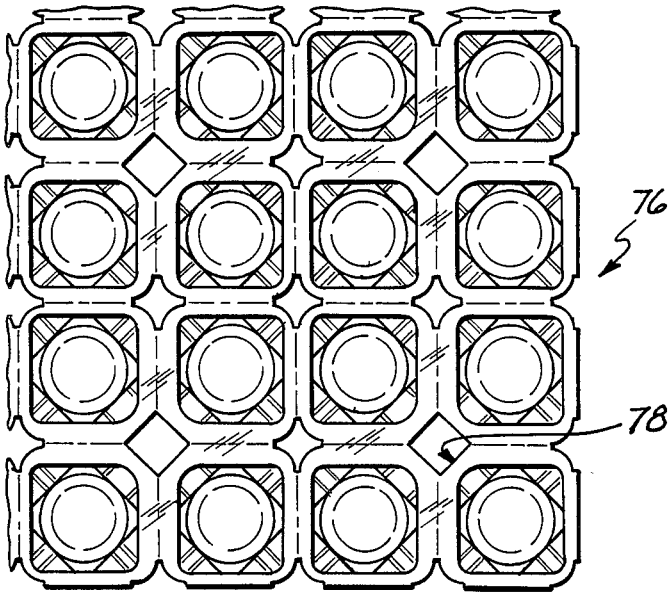

FIG..6 is a top plan view similar to FIG. 4, however showing a matrix of cups of the type seen in FIG. 5;

FIG. 7 is an isometric view of a further embodiment of the invention similar to FIGS. 5 and 1; and FIG. 8 is a plan view similar to FIGS. 4 and 6 showing a matrix of the cups of the type illustrated in FIG. 7.

This invention utilizes certain principles and/or concepts as are set forth in the claims appended hereto. Those skilled in the packaging arts will realize that these principles and/or concepts are capable of being utilized in a variety of embodiments which may differ from the embodiments utilized for illustrative purposes herein. For this reason this invention is not to be construed as being limited solely to the illustrative embodiments but should only be construed in view of the appended claims.

DETAILED DESCRIPTION

FIG. 1 illustrates a first fluted packaging cup of the invention. It is designed for packaging small quantities of products as, for instance, liquid or dry cream or artificial creamer for use in coffee or tea. It generally has the "feel" of a round container, however, it also has the characteristics of a square container which are better suited for manipulation on a fill and seal cup packager.

The cup is integrally formed from a resilient material in a thermo forming process. It is initially formed as one of a matrix of joined cups. FIG. 4 shows a portion (the lower right hand corner) of such a matrix of joined cups. Visible in FIG. 4 are three rows of three columns of joined cups. Typically, however, larger matrixes as, for instance, 8 by 8 matrixes would be manufactured for use on a fill and seal cup packager.

The cup 10 of FIG. 1 has a flat bottom wall 12 which is circular in shape. The bottom wall 12 is integrally connected about a smooth curve to a continuous side wall 14. The side wall 14, in turn, is integrally joined with the lip 16. The side wall extends from the lip 16 at a slight angle in order to provide "draft" for removing the matrix of cups from their forming die and for nesting.

It is evident from FIG. 1 that the rounded shape about the bottom wall 12 of the cup 10 is transferred into a square shape about the lip 16. This, thus serves to give the consumer a pseudo "round" container while allowing for manipulation of pseduo "square" containers on a form and fill cup packager.

A lid 18 is sealed to the lip 16 after the cup 10 is filled with product (not separately identified or shown). The seal formed is a hermetic but peelable seal commonly formed by fill and seal cup packagers.

While the cup 10 and other cups of the invention share certain characteristics with prior cups they differ from the prior cups in several unique respects. While initially the cups of the invention may appear identical, in reality they are not. As viewed from the inside of the cup 10, the cup has four fluted areas 20, 22, 24 and 26. These areas are considered fluted in that they are essentially formed as grooves from the interior of the cup. Three of the fluted areas 20, 22 and 24 are identical, with respect to each other; however the fourth fluted area 26 is disimilar with respect to the other three fluted areas.

The fluted areas 20, 22, 24 and 26 allow for smooth transition from the circular shape at the bottom wall 12 to a square shape where the lip 16 joins the continuous side wall 14 at an opening 28. It is evident from FIGS. 1 and 4 that at the periphery of the opening 28 the cup 10 is essentially squarish. This squarish nature at the top of the cup 10 at both the opening 28 and at the periphery of the lip 16 allows for ease of forming of the cup 10 as one of a matrix of cups as well as nesting of the matrix of cups in a carrier plate on a fill and seal cup packager.

As is evident from FIGS. 2 and 3, the fluted areas 20, 22, 24 and 26 are conical shaped surfaces which are formed by the intersection of a hypothetical plane with a hypothetical cone along a parabolic line of intersection. This parabolic line can be seen in side view in FIG. 3 for the fluted area 24. Also the planar nature of the intersection of the hypothetical plane with the hypothetical cone to form the conical surface of the fluted areas is visible in both FIG. 2 which shows a top view of all of the fluted areas and in FIG. 3 which shows a side view of the fluted areas 22 and 26. These conical surfaces can be described as having their base located at the point of intersection of the side wall 14 with the lip 16 and their apices as, for instance, apices 30 and 32 of fluted areas 24 and 26 seen in FIG. 3, located at the junction of the side wall 14 with the bottom wall 12.

The radius of curvature of the disimilar fluted area 26 is greater than the radius of curvature of the other three fluted areas which are identical with each other. As a result of this, the "corner" of the opening 28 within the fluted area 26 is not as sharp (that is it is more rounded) as are the corners of the opening 28 which lie within the other fluted areas.

The location of the apices of the fluted areas 20, 22, 24 and 26 adjacent to the intersection of the side wall 14 and the bottom wall 12 in combination with the remainder of the side wall 14 being a continuously smooth surface provides sufficient strength to the side wall 12 to prevent it from being crushed inwardly when being manipulated by a user of the cup 10. Thus, as opposed to other known prior cups, it is not necessary to incorporate a plurality of vertically extending flutes continuously all over the total side wall surface of the cup 10 in order to provide sufficient strength to the cup 10 for user manipulation. Further, this also allows for forming the bottom of the cup as a smooth flat surface not a surface with a ridge therein as was also practiced with prior cups.

The difference introduced into the fluted area 26 by enlarging its radius of curvature allows for the disimilar fluted area 26 to serve as a pouring spout for dispensing of product from the cup 10. Because the fluted area 26 has a larger radius of curvature, product can be smoothly dispensed from the cup 10 by tilting the cup 10 with this fluted area 26 oriented downwardly. This feature is augmented with additional features incorporated into the shape of the lip 16 as discussed below.

The outside periphery of the lip 16 of the cup 10 is formed as four straight edges 34, 36, 38 and 40. Each two adjacent edges hypothetically intersect at a sharp corner. In the cup 10 these hypothetical sharp corners are cut away to round these corners. The rounding of the corners is achieved as is evident in FIG. 4 by stamping out a star shape between each two adjacent four cups in the matrix of cups prior to loading of the cup matrix on a fill and seal cup packager. Additionally, outside corners as, for instance the lower right hand corner of FIG. 4 and corners along the outside edges are also stamped with a partial star shape to render each of the final corners of the cups 10 with a rounded shape.

The edges 34, 36, 38 and 40 of the independent cup 10 of FIG. 1 are shown as phantom lines in the still joined cup 42 located at the lower right hand corner of the matrices of cups 44 of FIG. 4. It is evident from FIG. 4 and also to a certain extent from FIG. 1 that the width of the area between the outside peripheral edges 38 and 40 and the periphery of the opening 46 of cup 42 is greater than the width of the area between the remaining two outside peripheral edges 34 and 36 and the periphery of the opening 46. Thus, the areas of the lip of cup 46 bounded the two edges 38 and 40 (which join at a first corner identified by the numeral 48) have a greater width than the areas of the lip of cup 42 bounded by the remaining two edges (which join at a second corner identified by the numeral 50).

This is achieved by offsetting the cup 42 along the diagonal bisector 52 which goes through corners 48 and 50. Line 54 in conjunction with diagonal bisector 52 traverses through the center of rotation of the circular bottom wall of the cup 42. Diagonal bisector 55, however, traverses through the corners (not separately numbered) where side 40 intersects side 34 and side 38 intersects 36. It is evident that line 55 is displaced toward corner 48 with respect to the center of the rounded bottom of the cup 42, that is line 55 is displaced toward corner 48 from line 54.

By displacing the point of intersection of diagonal bisectors of the outside squarish shape of the lip 16 with respect to the center of the bottom wall of the cup, the edges of the lip are made offset. Thus, the center of the interior of the reservoir which is formed by the bottom wall 12 and the side wall 14 is displaced along a diagonal bisector from the center (the point of intersection of its diagonal bisectors) of the square periphery of the cup lip.

The fluted area 26 is formed such that it is oriented toward the corner 48 of FIG. 4. Thus, this fluted area is positioned adjacent to the first corner 48 where the first two outside peripheral edges 38 and 40 intersect each other.

As a consequence of positioning the fluted area 26 toward the areas of the lip wherein there is an increase in width of the lip, dispensing of the product from the cup 10 is facilitated. Thus, in dispensing of the product not only is product channeled down the greater radius of curvature of fluted area 26, but is also dispensed over the widest part of the lip allowing it to flow smoothly from the cup 10 over the edge of the lip to a receiving container.

Two other cups of the invention are shown in FIGS. 5 through 8. These cups differ from the cup 10 (or the joined cup 42) only with respect to the shape of the corners of their lips. The body of the cup, i.e. the reservoir formed by the side wall 14 and the bottom wall 12 including the fluted areas 20, 22, 24 and 26, are identical to those of cup 10 and thus are identified by the same numerals used for cup 10. Because of this only the lip area of the cups of the embodiments shown in FIGS. 5 and 7 will be described, it being understood that the remainder of these cups are as previously described for cup 10.

FIG. 5 shows a further cup 56 of the invention. Additionally a joined matrix 58 of cups 56 are shown in FIG. 6. The cup 56 differs from the cup 10 with respect to treatment given to one lip corner, i.e. corner 60 of its lip 62. The corner 60 is adjacent to the disimilar fluted area 26. Instead of being rounded as was the corner of the cup 10, the corner 60 of the cup 56 is pointed and shaped in a 90° angle. This facilitates dispensing of a liquid product off of the surface of the corner 62.

As seen in FIG. 6 in forming cup 60, a modified pattern of star like cuts is utilized. For each four adjacent cups, at one point (corner) where they are connected the star shape cut is not used as was for the embodiment of FIG. 4. Instead at this point crossed straight cuts (a +shaped cut) are used separate the cups from one another. This thus forms the corners 60. Note that this is only used at one corner. At the other three corners, the star shaped cut is used.

In FIG. 7 a further cup 64 of the invention is illustrated. For the cup 64 at the corner of its lip 66 adjacent to the disimilar fluted area 26, a truncated 90° corner 68 is formed. This creates a further edge 70. Edge 70 forms a 135° angle with both edge 72 and 74.

The formation of the corner of FIG. 7 is evident from FIG. 8 wherein a matrix 76 of the cup 64 is illustrated. To form the corner 68 a diamond shaped die hole 78 is punched between four adjacent connected cups in the matrix 76.

As with the embodiment of FIG. 4, the cups 56 and 64 also are positioned such that wider lip areas are formed adjacent to their dispensing corner and as noted above they also include a disimilar fluted area.

I claim:

1. A packaging cup comprising:

a resilient integrally formed body having a product reservoir and a lip;

said reservoir including a flat bottom wall and a continuous side wall integrally formed together, said side wall extending from said bottom wall to said lip and integrally joined to said lip;

the joint between said lip and said side wall continuously surrounding and defining an opening through said lip to the interior of said reservoir, said lip extending in a plane outwardly from said opening completely around the periphery of said opening;

said bottom wall essentially circular in shape;
said opening essentially squarish in shape;
first, second, third and fourth fluted areas as viewed from the interior of said reservoir located in said side wall at the corners of said squarish shaped opening, each of said fluted areas shaped essentially as a conical surface generated from a cone truncated by a plane about a parabolic intersection of the plane with the cone and having the base of the conical surface located at the joint of the lip with the side wall and the apex of the conical surface oriented towards said bottom wall and further including the remainder of said side wall being smooth; and
three of said fluted areas being identical and the remaining one of said fluted areas being disimilar with respect to the three identical fluted areas.

2. A packaging cup of claim 1 wherein:
the apex of the conical surface of each of said identical fluted areas is positioned essentially at the intersection of said side wall with said bottom wall.

3. A packaging cup of claim 1 wherein:
the conical surface of said disimilar fluted area has a greater radius of curvature than the radius of curvature of the three identical fluted areas.

4. A packaging cup of claim 1 wherein:
the apex of the conical surface of each of said identical fluted areas and said disimilar fluted area are positioned at the intersection of said side wall with said bottom wall.

5. A packaging cup of claim 1 wherein:
said lip has an outside periphery, said outside periphery being divided into four essentially equal outside edges joined together at corners to essentially form a square shape.

6. A packaging cup of claim 5 wherein:
each of the corners wherein said outside edges of said lip meet are essentially rounded.

7. A packaging cup of claim 5 wherein:
three of the corners wherein said outside edges of said lip meet are essentially rounded and the remaining corner is essentially a 90° angle.

8. A packaging cup of claim 5 wherein:
three of the corners wherein said outside edges of said lip meet are essentially round and the remaining corner is truncated having an edge which is angled essentially at 135° from two of the outside edges forming said remaining corner.

9. A packaging cup of claim 1 wherein:
said lip has an outside periphery, said outside periphery being divided into four essentially equal outside edges joined together at corners to essentially form a square shape; and
the center of said essentially circular bottom wall is offset from the point of intersection of diagonal lines bisecting the corners of said essentially square shape of the outside periphery of said lip.

10. A packaging cup of claim 9 wherein:
said center of said essentially circular bottom wall from the point of intersection of said diagonal lines bisecting said corners of said outside periphery of said lip lies along a diagonal line which also bisects said disimilar fluted area.

11. A packaging cup of claim 9 wherein:
said point of intersection of said diagonal lines bisecting said corners of said outside periphery of said lip is positioned as measured along a diagonal line which also bisects said larger fluted area lies between said larger fluted area and said center of said essentially circular bottom wall.

12. A packaging cup of claim 5 wherein:
a first two of said outside edges of said lip intersect at a first corner and the remaining two of said outside edges of said lip intersect at a second corner; and
the areas of said lip between said first two intersecting outside edges and said periphery of said opening being greater in width than areas of said lip between said remaining two intersecting outside edges and the periphery of said opening.

13. A packaging cup of claim 12 wherein:
said disimilar fluted area is positioned adjacent to said first corner wherein said first two of said outside edges of said lip intersect.

14. A packaging cup comprising:
a resilient integrally formed body having a product reservoir and a lip;
said reservoir including a flat bottom wall and a continuous side wall integrally formed together, said side wall extending from said bottom wall to said lip and integrally joined to said lip;
the joint between said lip and said side wall continuously surrounding and defining an opening through said lip to the interior of said reservoir, said lip extending in a plane outwardly from said opening completely around the periphery of said opening;
said bottom wall essentially circular in shape;
said opening essentially squarish in shape;
first, second, third and fourth fluted areas as viewed from the interior of said reservoir located in said side wall at the corners of said squarish shaped opening, each of said fluted areas shaped essentially as a conical surface generated from a cone truncated by a plane about a parabolic intersection of the plane with the cone and having the base of the conical surface located at the joint of the lip with the side wall and the apex of the conical surface oriented towards said bottom wall and further including the remainder of said side wall being smooth
said lip has an outside periphery, said outside periphery being divided into four essentially equal outside edges joined together at corners to essentially form a square shape; and
the center of said essentially circular bottom wall is offset from the point of intersection of diagonal lines bisecting the corners of said essentially square shape of the outside periphery of said lip.

15. A packaging cup of claim 14 wherein:
said center of said essentially circular bottom wall from the point of intersection of said diagonal lines bisecting said corners of said outside periphery of said lip lies along a diagonal line which also bisects said disimilar fluted area.

16. A packaging cup of claim 14 wherein:
said point of intersection of said diagonal lines bisecting said corners of said outside periphery of said lip is positioned as measured along a diagonal line which also bisects said disimilar fluted area lies between said disimilar fluted area and said center of said essentially circular bottom wall.

17. A packaging cup comprising:
a resilient integrally formed body having a product reservoir and a lip;
said reservoir including a flat bottom wall and a continuous side wall integrally formed together, said side wall extending from said bottom wall to said lip and integrally joined to said lip;

the joint between said lip and said side wall continuously surrounding and defining an opening through said lip to the interior of said reservoir, said lip extending in a plane outwardly from said opening completely around the periphery of said opening;

said bottom wall essentially circular in shape;

said opening essentially squarish in shape;

first, second, third and fourth fluted areas as viewed from the interior of said reservoir located in said side wall at the corners of said squarish shaped opening, each of said fluted areas shaped essentially as a conical surface generated from a cone truncated by a plane about a parabolic intersection of the plane with the cone and having the base of the conical surface located at the joint of the lip with the side wall and the apex of the conical surface oriented towards said bottom wall and further including the remainder of said side wall except for said first, second, third and fourth fluted areas being an essentially smooth continuous surface;

said lip has an outside periphery, said outside periphery being divided into four essentially equal outside edges joined together at corners to essentially form a square shape;

a first two of said outside edges of said lip intersecting at a first corner and the remaining two of said outside edges of said lip intersecting at a second corner; and the areas of said lip between said first two intersecting outside edges and said periphery of said opening being greater in width than areas of said lip between said remaining two intersecting outside edges and the periphery of said opening.

18. A packaging cup of claim 17 including:

three of said fluted areas being identical and the remaining one of said fluted areas being disimilar with respect to the three identical fluted areas.

19. A packaging cup of claim 18 wherein:

said disimilar fluted area is positioned adjacent to said first corner wherein said first two of said outside edges of said lip intersect.

20. A packaging cup of claim 18 wherein:

the conical surface of said disimilar fluted area has a greater radius of curvature than the radius of curvature of the three identical fluted areas.

* * * * *

UNITED STATES PATENT AND TRADEMARK OFFICE

CERTIFICATE OF CORRECTION

PATENT NO. : 4,875,620

DATED : OCTOBER 24, 1989

INVENTOR(S) : WILLIAM A. LANE, SR.

It is certified that error appears in the above-identified patent and that said Letters Patent is hereby corrected as shown below:

Column 3, line 26, "of" should be --as--.

Column 3, line 32, "Fig.. 6" should be --Fig. 6--.

Column 3, lines 63 and 64, "matrixes" should be --matrices--.

Column 6, line 38, insert --to-- between "used" and "separate".

Column 7, line 45, "round" should be --rounded--.

Column 8, line 42, "smooth" should be --smooth;--.

Signed and Sealed this

Fourteenth Day of July, 1992

*Attest:*

DOUGLAS B. COMER

*Attesting Officer*

*Acting Commissioner of Patents and Trademarks*